US006520349B2

(12) United States Patent
Keen

(10) Patent No.: US 6,520,349 B2
(45) Date of Patent: Feb. 18, 2003

(54) GARMENT HANGER CADDY

(76) Inventor: Cletus F. Keen, 2736 S. Punta Del Este, Hacienda Heights, CA (US) 91745

( * ) Notice: Subject to any disclaimer, the term of this patent is extended or adjusted under 35 U.S.C. 154(b) by 0 days.

(21) Appl. No.: 09/809,206

(22) Filed: Mar. 16, 2001

(65) Prior Publication Data

US 2002/0130094 A1 Sep. 19, 2002

(51) Int. Cl.[7] ..... A47F 7/00

(52) U.S. Cl. ..... 211/49.1; 211/106; 211/181.1; 223/85

(58) Field of Search ..... 211/49.1, 59.1, 211/181.1, 162, 106; 248/175, 121, 309.1; 223/85

(56) References Cited

U.S. PATENT DOCUMENTS

| | | | | | |
|---|---|---|---|---|---|
| 891,490 | A | * | 6/1908 | Lippold | 211/51 |
| 978,422 | A | * | 12/1910 | Zizinia | 211/49.1 |
| 2,122,324 | A | | 6/1938 | McDermott | |
| 2,530,609 | A | | 11/1950 | Friedman | |
| 2,918,174 | A | | 12/1959 | Tabbi | |
| 3,468,509 | A | * | 9/1969 | Foltz | 248/316 |
| 3,490,599 | A | | 1/1970 | Maur, Jr. | |
| 3,661,268 | A | * | 5/1972 | Boley | 211/49.1 |
| 3,692,188 | A | | 9/1972 | Bayne | |
| 4,016,981 | A | | 4/1977 | Hildt | |
| 4,415,137 | A | * | 11/1983 | Garves | 248/629 |
| 4,424,905 | A | | 1/1984 | Keen | |
| 4,583,646 | A | * | 4/1986 | Bowman | 211/32 |
| 4,632,256 | A | * | 12/1986 | Gambello | 211/50 |
| 4,768,658 | A | | 9/1988 | Shafto | |
| D335,402 | S | | 5/1993 | Eckner | |
| 5,373,979 | A | * | 12/1994 | Moore | 224/42.46 |
| 5,765,801 | A | * | 6/1998 | Geiselman | 248/552 |
| 5,924,578 | A | | 7/1999 | McKenzie | |
| D417,802 | S | | 12/1999 | Spurgeon et al. | |
| 6,230,904 | B1 | * | 5/2001 | Licari | 211/49.1 |

* cited by examiner

*Primary Examiner*—Daniel P. Stodola
*Assistant Examiner*—Khoa Tran
(74) *Attorney, Agent, or Firm*—Jacobson Holman PLLC

(57) ABSTRACT

A fixture that accepts all types of hangers by aligning a hanger hook in only one direction. A glide rod and a pivotal hook guide rod hold the hanger hooks in a predetermined position on the hanger stacker fixture. The hook guide rod extends approximately 25½" from the base. At the base, the hook guide rod is pivotally connected to the bottom of the glide rod. The opposite end of the hook guide rod is pivotally connected to a hoop carrying handle allowing the hook guide rod to swing or pivot away to an open position providing free access to the glide rod for removal of hangers.

16 Claims, 6 Drawing Sheets

GARMENT HANGER CADDY

FIELD OF THE INVENTION

The present invention relates to a hanger caddy operable in two positions for storing hangers and for release of stacked, stored hangers.

BACKGROUND OF THE INVENTION

Millions of plastic garment hangers are removed from clothing each day at point-of-sale in retail stores. These hangers must be dealt with in the back rooms of the stores through a process of untangling, sorting by style and organizing them for re-use. This is a serious problem because of labor intensiveness, cost of broken hangers ($0.25 to $1.00 each) due to tangle, storage space and retail efficiency. In addition, new federal and state regulations against discarding plastic hangers into the nation's landfills, makes recycling for all retail stores a necessity.

Successful hanger management is thwarted by the multiplicity of hanger styles used in retail stores. Previous attempts to sort and organize all hangers have failed because no one hanger management system will accept and sort all hangers.

At present, to sort hangers, boxes of various materials and sizes are used at point of sale. Hangers removed by sales clerks are thrown into these boxes. When full, the boxes of hangers are removed to the back of the retail establishment, the hangers untangled and sorted for re-use. This method is the most frequently used system and the most costly from the standpoint of labor costs, efficiency and broken hanger expense.

A hair-pin fixture sorting method uses a metal fixture consisting of two metal hoops, one shorter than the other. The hanger hook is placed in the tallest hoop and hanger arms are placed between the two hoops. This method makes no attempt to align hooks or separate hooks by style. This system is only slightly superior to the box sorting method because of tangling of hangers, broken hangers still exist and re-sorting is still necessary.

The bar sorting system uses three to six bars approximately 24 inches long. Each bar is designated for a specific hanger type and sortation results to some degree, dependent completely on employee discipline. In operation, serious problems develop if foam rubber hold downs unlock in which case all hangers can fall off the bars during transfer from a bar rack at a point of sale to a rolling rack for transfer to a back room. Bars must be held horizontal and hangers tend to swing out of alignment and frustrate easy loading on rolling racks. This system is the most expensive hanger management system mainly because it has a very elaborate racking system required to hold hangers, its many plastic pieces and foam rubber parts that require replacement.

It has been determined that the critical distance for a hanger is the center of the hanger hook to the shoulders or arms of the hanger. Since this distance varies by style, retail chain dedicated hangers and manufacturer, a number of hanger fixtures are required and designed to accept each particular hanger type. This clearly is unacceptable, costly, confusing and unworkable because of space requirements.

Hanger standardization then would seem to be the only real solution; however, this solution would have to be industry-wide. This apparently will not happen in view of the large investment in the present inventory of retail hangers which would have to be scrapped and replaced with new standardized hangers at a substantial cost. Since the problem remains, the problem to be solved must be how to bring order and efficiency to the tangle and confusion of the costly hanger management problem.

SUMMARY OF THE INVENTION

A detailed examination of the multiplicity of hanger styles reveals a startling consistency in the midst of all this confusion. The swivel metal hook on the garment hanger, on 99 percent of all hangers, is standardized.

With this fact in mind, the present invention includes a fixture that aligns the hanger hook in only one direction. In addition, a "glide rod", a "guide rod" and a "hook guide rod" loosely hold the hanger hooks in a predetermined position on the hanger stacker fixture.

The hanger caddy of the present invention allows hangers to be sorted by style if desired or to be used for acceptance of all styles on one caddy fixture. In the later instance, the various hanger styles can easily be removed when the fixture is hung horizontally by its base, unfastening the top hold clamp and swinging the "hook guide rod" up for clear and easy removal of one or several hangers from the glide rod.

The present invention is designed to accept all garment hangers for the purpose of collecting, organizing and sorting garment hangers for efficient recycling and re-use. These hangers include plastic and metal hangers as well as wood hangers which use a swivel metal hook. Most non-swivel hangers are also accommodated.

The present invention is essentially an efficient hanger management system for both small and large clothing stores and chain stores. Since no other system now offers this capability, this system is truly unique.

The metal fixture of the present invention consists of ⅝" metal rod construction through-out, having a base configured in a pie-shape to allow four fixtures to occupy approximately a 15"×15" space which is very space efficient for a retail store.

Two upwardly extending, parallel vertical guide rods extend from the base providing support and stability to the fixture. One of the guide rods guides an arm of the hanger, whereas the other guide rod guides the base of the hook of the hanger.

A glide rod located between the two guide rods, extends 29" vertically from the base. The top 4 ½ inches of the glide rod become the "neck" of the fixture, providing a projection for the hook of the hanger to easily grab or hook the "glide" rod which after release of the hanger by the employee glides down to the base with one of the arms of the hanger contacting one of the guide rods while the base of the hanger hook contacts the other guide rod.

The top of the glide rod bends back parallel and downwardly 4 ½". The glide rod is then bent at a 90 degree angle and is welded to a hoop to form a support for the fixture.

A second rod, one of the two "guide rods", extends upwardly from the base approximately 25 ½ inches where it bends 90 degrees to form the hoop encircling the glide rod, which serves as a carrying handle and a support for the fixture and is connected to the downward projection of the glide rod. The right side of the hoop bends back parallel to the other leg of the hoop and downwardly at 90 degrees to form an axis or pivot connection with the other of the two guides rods, the "hook guide rod".

The hook guide rod forming the other of the two guide rods extends approximately 25 ½" from the base. At the base, the hook guide rod is pivotally connected to the bottom of the glide rod. The opposite end of the hook guide rod is pivotally connected to the hoop carrying handle allowing the hook guide rod to swing or pivot away to an open position through 300° of rotation, providing free access to the glide rod for removal of hangers.

The hook guide rod allows easy and efficient access to the hangers that are stacked or gathered on the fixture. It also allows the holding of the hangers in place by engaging the hanger hook and thus holding hangers securely on these fixtures no matter what hanger style is involved.

The tie-down strap or clamp is necessary to secure the hook guide rod in place in a closed position and prevent it from pivoting. This strap or clamp would be secured at all times until the fixture is ready to be placed in a horizontal position and unloaded. A wall mounted bracket is used to hang the fixture from two hooks designed to attach to the base on opposite sides of the glide rod. The strap or clamp would then be disconnected or released and the hook guide rod would be swung up and out of the way giving open access to the hangers.

It should be noted that the bottom axle of the hook guide rod will have a "stop protrusion" that will engage with the toe of the glide rod to maintain the hook guide rod in the open position. The stop will be welded to the hook guide rod.

To operate the system of the present invention, at the point of sale, a hanger is removed from a garment. The employee takes the hanger by the arm and hooks the hook of the hanger around the projecting neck of the glide rod and releases the hanger. The hanger glides down the glide rod to the base. The hanger hook can not be placed on the fixture incorrectly. A support bar between the glide rod and one of the guide rods blocks acceptance of hanger hooks incorrectly oriented on the glide rod and then, with the hook guide rod insures all hanger hooks are in perfect alignment. The present invention has the only "fail-safe" employee proof hanger management system.

The universal hanger fixture can be used in the vertical position, such as beside a cash register or a cluster of four fixtures can also be located near a register of a store. The fixture can also be used under the register or cash wrap stand when mounted on a bracket which holds the caddy fixture at an 18 degree angle allowing the hanger hook to be placed on the "neck" of the glide rod and released to have the hanger glide down slowly by gravity down to the base of the fixture. The gravity feed feature of the present invention provides for a simple fixture with no complicated moving or replaceable parts, only a pivotable hook guide rod.

The garment hanger fixture of the present invention solves most of the problems associated with hanger management systems. It focuses on the only standard feature of all hangers regardless of style, the swivel hook. By ensuring that all of the hooks of the hangers are aligned in only one direction and that the base of the hook and one arm of the hanger are held in position by the guide rods, the variable size of the hanger itself is unimportant. By accepting all hangers, the hanger caddy of the present invention becomes a universal hanger management fixture.

The introduction of the "swing-away" hook guide rod that holds the bottom of the hanger hook in an aligned position, not only allows universality by accepting all hangers but provides the important additional benefit of "easy" removal of various styles of hangers without tangle or breakage. The labor intensive cost of resorting from boxes, etc., has been all but eliminated by this feature.

The tie-down strap or clamp at the top of the fixture holds the hook guide rod in an operating position. The tie-down strap or clamp can be made of metal or plastic which fastens to the hoop frame and is held in the closed position by a snap lock or swivel slot lock engaging the hook guide rod. When unlocked, the hook guide rod can be swung upwardly to provide clear access to the hangers for easy unobstructed removal during the sorting process. This procedure, of course, would only be performed when the caddy fixture is hung in the horizontal unloading position.

The garment hanger fixture operates in a number of different modes. In a first vertical up-right mode, the fixture stands against the cash-wrap and hangers are "hooked" on the neck of the glide rod and merely released allowing gravity to let the hanger glide to the base of the fixture. It may also be operated in a second cluster of four mode utilizing the pie-shaped base allowing for minimum usage of floor space. The third operating mode is at an angle of 15 to 18 degrees and is mounted by a mounting bracket under the cash-wrap counter. The neck of the caddy extends beyond the edge of the counter allowing hanger hooks to be placed on the neck of the glide rod and letting hangers glide down to the base.

The mounting bracket can be used individually or in multiple arrangements, for example, one above another, properly spaced and allowing a rack of up to five caddys to be hung from a storage room wall for storage or "sorting purposes." This rack arrangement can be used "under" the point of sale cash wrap to accommodate two universal caddys, one above the other, in a 15" by 27" space, thus removing the hangers from view. As will be seen, the "toe" of the base fits into the mounting bracket, accepting a base end of the glide rod in a "slot" of a center metal plate of the bracket and allowing the base of the fixture to "rest" at an 18 degree bend-back angle, thus holding the caddy at the proper angle so hangers "glide" downwardly to the base and stack.

Since the garment hanger caddy accepts a wide variety of hangers, sorting of hangers for reuse will be necessary. Therefore a system to simplify and expedite the recycling and reuse of hangers is needed. A mounting rack of five brackets would be mounted on the wall of the sorting area. Empty universal caddys would be placed on four of the brackets with the "hook guide rod" swung up in the open position allowing clear access to the "glide rod". The fifth bracket would be used for the fully loaded caddy that needs to be sorted. The particular mounting bracket chosen would be the bracket height most convenient for the height of the sorting employee.

Each of the empty caddys would be designated for specific hanger styles. As more and more caddys from the sales floor are unloaded and sorted onto the other caddys by style and become loaded, the "hook guide rod" is swung down and secured in position by a tie-down strap or clamp and the caddy is removed for reuse and another empty caddy put in place on the mounting rack. Caddys that have been permanently dedicated to a particular style of hanger can be used at re-hangering positions and fitting rooms with the center mounting piece of the bracket screwed into the wall to hold the designated hanger caddy in place.

It is an object of the present invention to provide a garment hanger caddy that is capable of accepting all types of hangers and holding the hangers in an aligned position.

It is another object of the present invention to provide a garment hanger caddy for holding a plurality of different hangers in an aligned position with a hook guide rod movable between a closed position for storing the hangers on the caddy and an open position for gaining access to the hangers located on a glide rod.

It is still another object of the present invention to provide a hanger caddy for storing a plurality of hangers in an aligned orientation with a pivotable hook guide rod movable between a closed position and an opened position where access is gained to aligned hangers located on a glide rod.

It is still yet another object of the present invention to align a plurality of hanger caddys at an angle of between 15 to 18 degrees with respect to a vertical wall so as to remove hangers from one caddy and sort the hangers onto a plurality of other caddys in a quick and easy matter.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
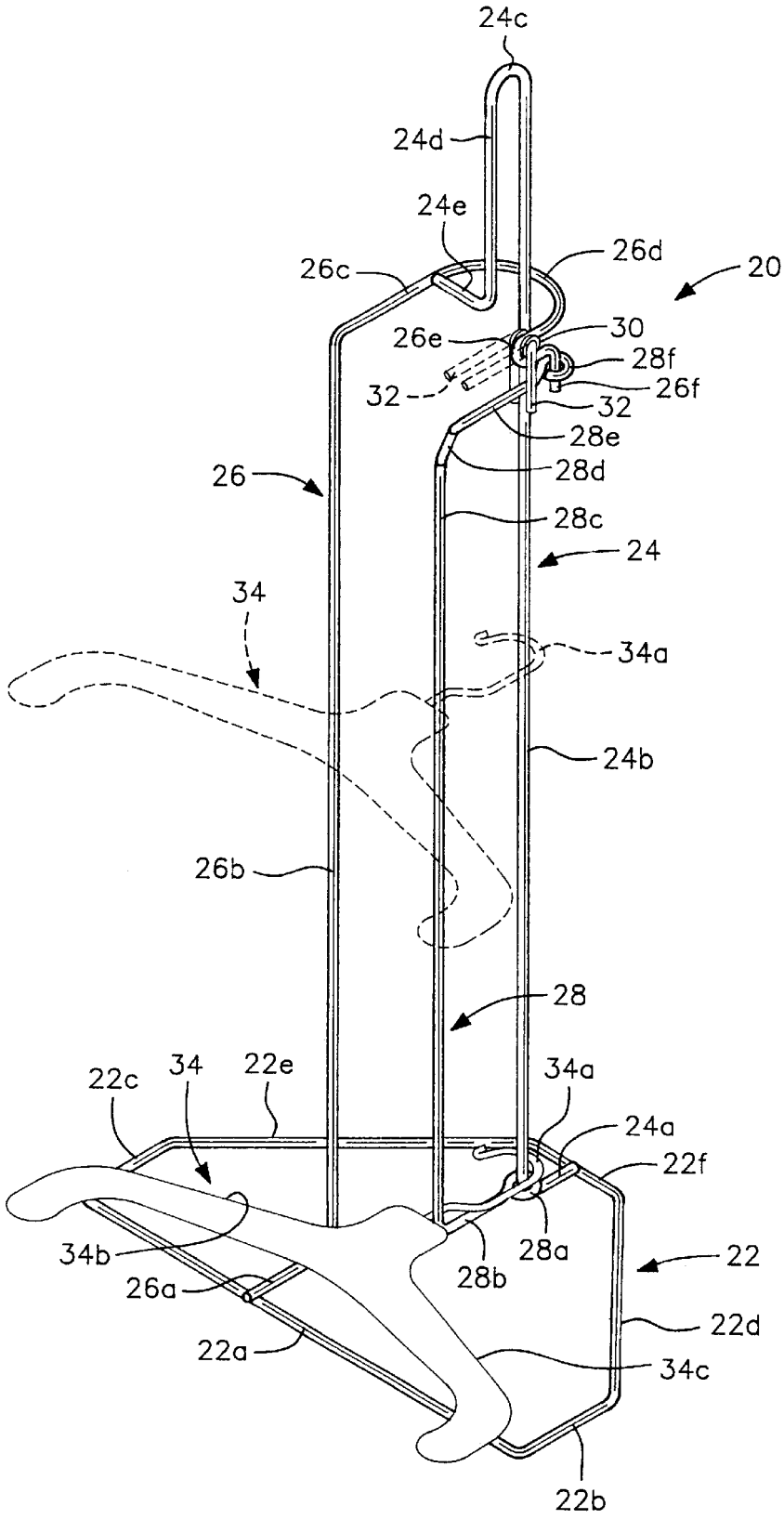
FIG. 1 is a perspective view of the garment hanger caddy of the present invention showing the placement of a plurality of hangers with the hook of the hangers sliding on a glide rod and against a hook guide rod with an arm of the hanger being positioned against another guide rod, the two guide rods being located on opposite sides of the glide rod.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

With reference to the drawings, in general, and to FIGS. 1 through 7, in particular, a garment hanger caddy embodying the teachings of the subject invention is generally designated as 20. With reference to its orientation in FIG. 1, the garment hanger caddy includes a pie shaped base 22, a glide rod 24, left side guide rod 26 and a pivotally mounted hook guide rod 28.

In FIG. 1, the base 22 is made of a welded rod including section 22*a* of approximately 9¼ inches in length, section 22*b* and 22*c* of approximately 1 ¾ inches in length, sections 22*d* and 22*e* of approximately six inches in length and section 22*f* of approximately three inches in length. The dimensioning of the base allows four caddys to nest together in an approximately 15×15 inch space to conserve space so as to save shipping and manufacturing costs.

Extending inwardly from section 22*a* of the base 22 is section 26*a* of guide rod 26 which then turns 90 degrees to form section 26*b* extending to a height of 25 ½ inches above base 22. Section 26*c* then turns 90 degrees with respect to section 26*b* and terminates in hoop shaped section 26*d*. A U-shaped curved section 26*e* terminates in downwardly directing end section 26*f*.

With respect to the glide rod 24, section 24*a* extends from base section 22*f* and then turns 90 degrees to travel vertically, by section 24*b* to a height of approximately 29 inches. The glide rod turns on itself by U-shaped section 24*c*, traveling downwardly for a distance of approximately 4 ½ inches through section 24*d* and then turning 90 degrees through section 24*e* which is welded to section 26*c* of left side guide rod 26.

Movable hook guide rod 28 has base end section 28*a* encircling the base portion of section 24*b* of the glide rod. Section 28*b* extends from pivotable end 28*a* to connect with section 28*c*. Section 28*c* extends for approximately 25 inches until reaching outwardly bending section 28*d*, terminating in horizontally extending section 28*e*. Terminal end 28*f* of the hook guide rod encircles downwardly projecting section 26*f* of the terminal end of left guide rod 26.

Trapped in U-shaped section 26*e*, adjacent the end of the left guide rod 26, is a rubber friction sleeve 30. Passing through an opening in the sleeve 30 is a U-shaped clamp or connector 32 having its crosspiece passing through the sleeve 30. The two legs of the clamp 32 are located in the position shown in FIG. 1 in solid lines, on opposite sides of section 28*e* of the hook guide bar 28.

In FIG. 1, a hanger 34 having hanger hook 34*a* and shoulder or arm sections 34*b* and 34*c* is shown. The hanger hook 34*a* is positioned so as to be located between section 24*b* of the glide rod 24 and hoop shaped section 26*d* of the left guide rod 26. The section 24*e* prevents the hanger hook 34*a* from being positioned other than in the orientation shown in FIG. 1, such that hangers 34 are dropped, when the hanger caddy 20 is in a vertical orientation as shown in FIG. 1 with the hanger hook 34*a* engaging or being guided by glide rod 24 and hook guide rod 28 with an arm 34*b* of the hanger engaging or being guided by guide rod 26. Arm 34*c* does not need a guide due to the contact of the hanger hook with the hook guide rod and the glide rod.

Figure 2:
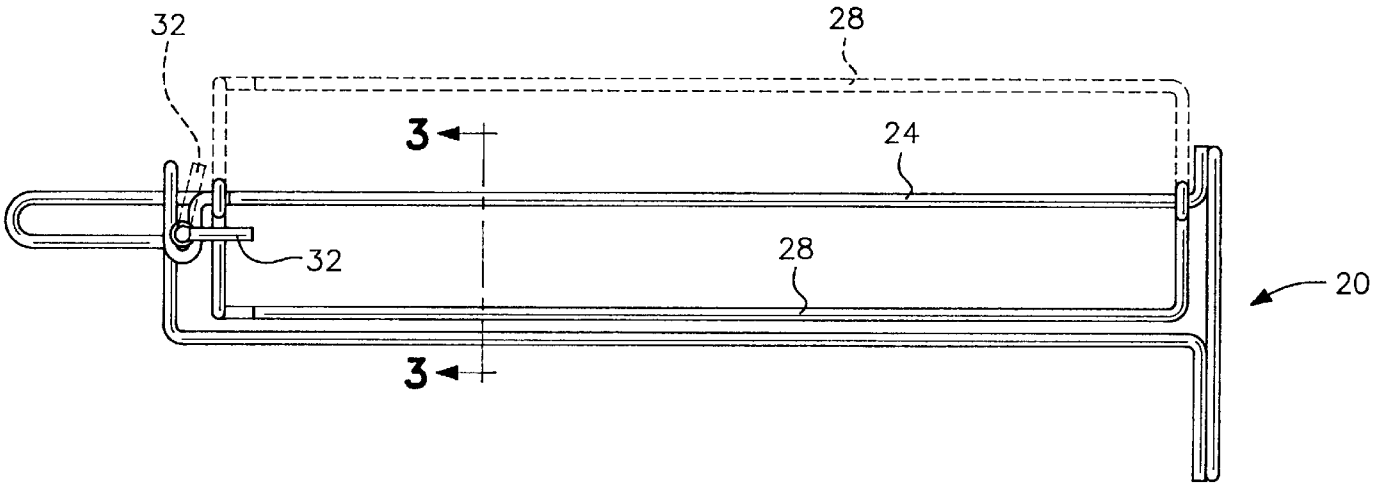
FIG. 2 illustrates the horizontal positioning of the garment hanger caddy of the present invention with one of the guide rods being pivoted from a closed position to an open position so as to gain access to hangers positioned on a glide rod.
Figure 5:
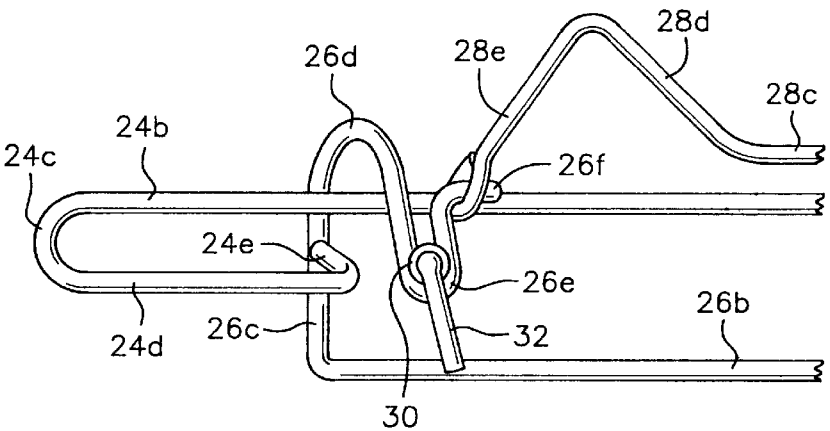
FIG. 5 illustrates the top end of the garment hanger caddy with the hook guide rod pivoted to a position to gain access to the glide rid for removal of hangers.
Figure 6:
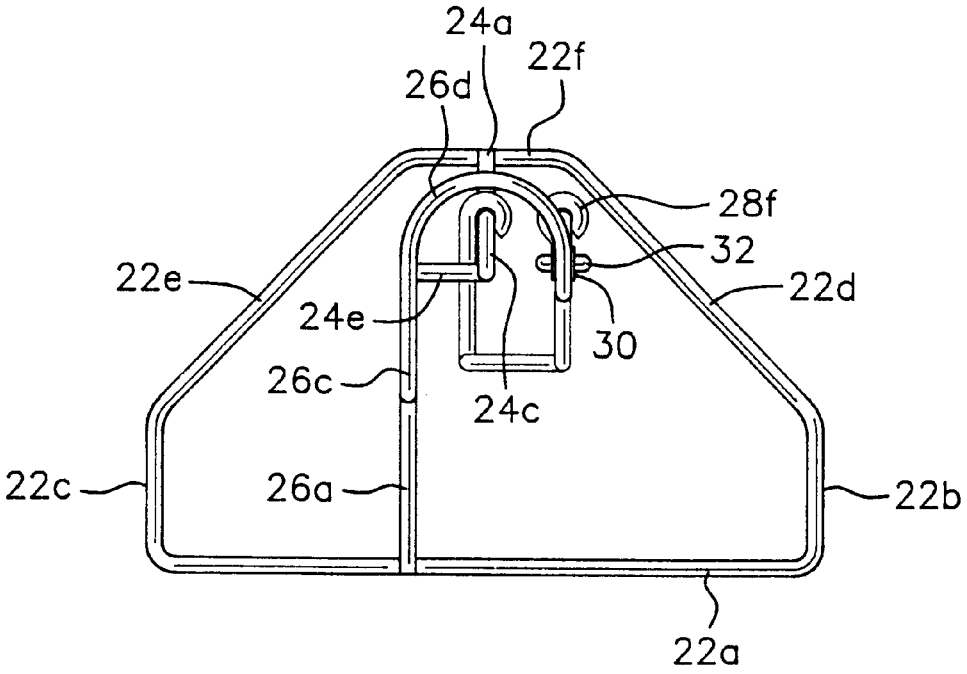
FIG. 6 is a plan view of the garment hanger caddy of the present invention with the hook guide rod shown in the closed position.
Figure 7:
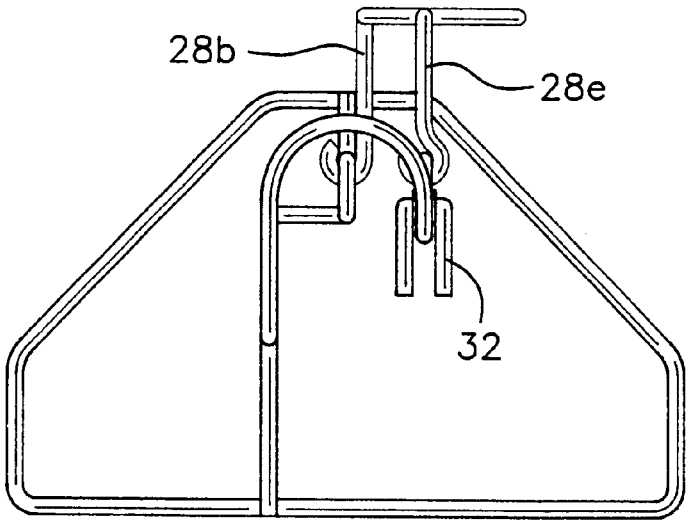
FIG. 7 is a plan view of the garment hanger caddy of the present invention with the hook guide rod pivoted to an open position after pivotal movement of a U-shaped clamp bar.

When the hanger caddy is moved into a horizontal orientation as shown in FIG. 2, and the legs of the clamp 32 are pivoted about its crosspiece to the position shown in dotted lines in FIGS. 1 and 2 and in FIG. 7, the hook guide rod is pivotable about its ends 28*a* and 28*f* from the position shown in solid lines in FIGS. 2 and 6 to the position shown in dotted lines in FIG. 2.

Figure 4:
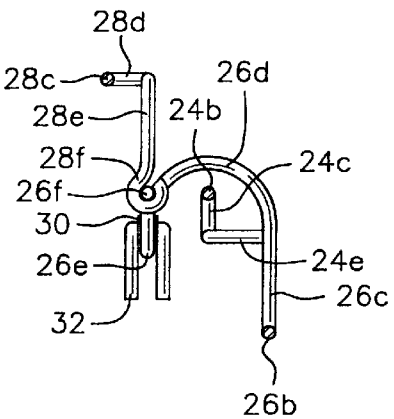
FIG. 4 is a cross-sectional view, similar to FIG. 3, however in this Figure, the hook guide rod is pivoted to an open position to gain access to the glide rod.
Figure 3:
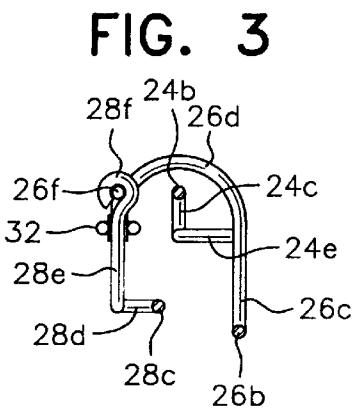
FIG. 3 is a sectional view taken along line 3—3 of FIG. 4 with the hook guide rod in a closed operating position.

Movement of the hook guide rod to a position above or beyond glide rod 24, allows access to hangers stacked on glide rod 24. The hangers may be lifted slightly to clear the engagement of the hanger hook with the glide rod 24 and then the hangers are moved transversely for removal of the hangers from the hanger caddy 20. A schematic illustration of the movement of the hook guide rod is shown in FIGS. 3 and 4.

Figure 8:
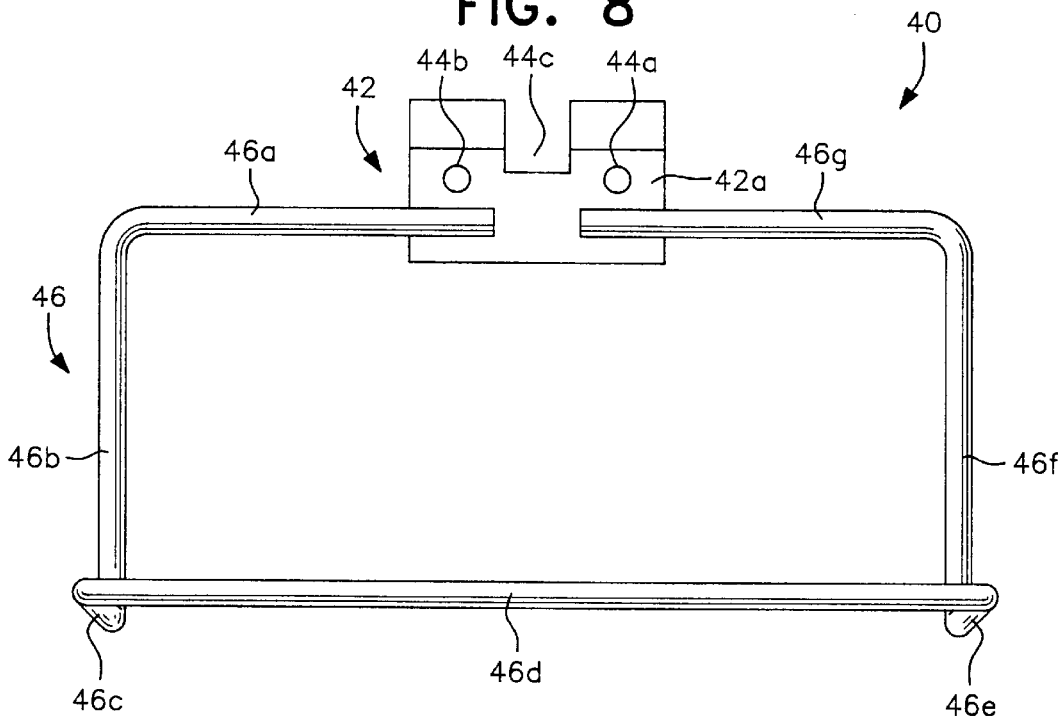
FIG. 8 is a front view of a bracket to be used to mount a garment hanger caddy of the present invention at an angle of 15 to 18 degrees with respect to a vertical wall.
Figure 9:
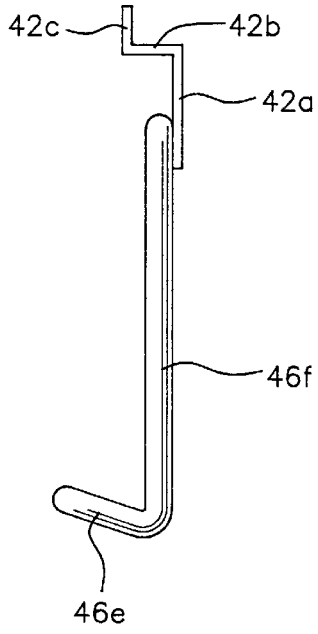
FIG. 9 is a side view of the mounting bracket shown in FIG. 8.
Figure 10:
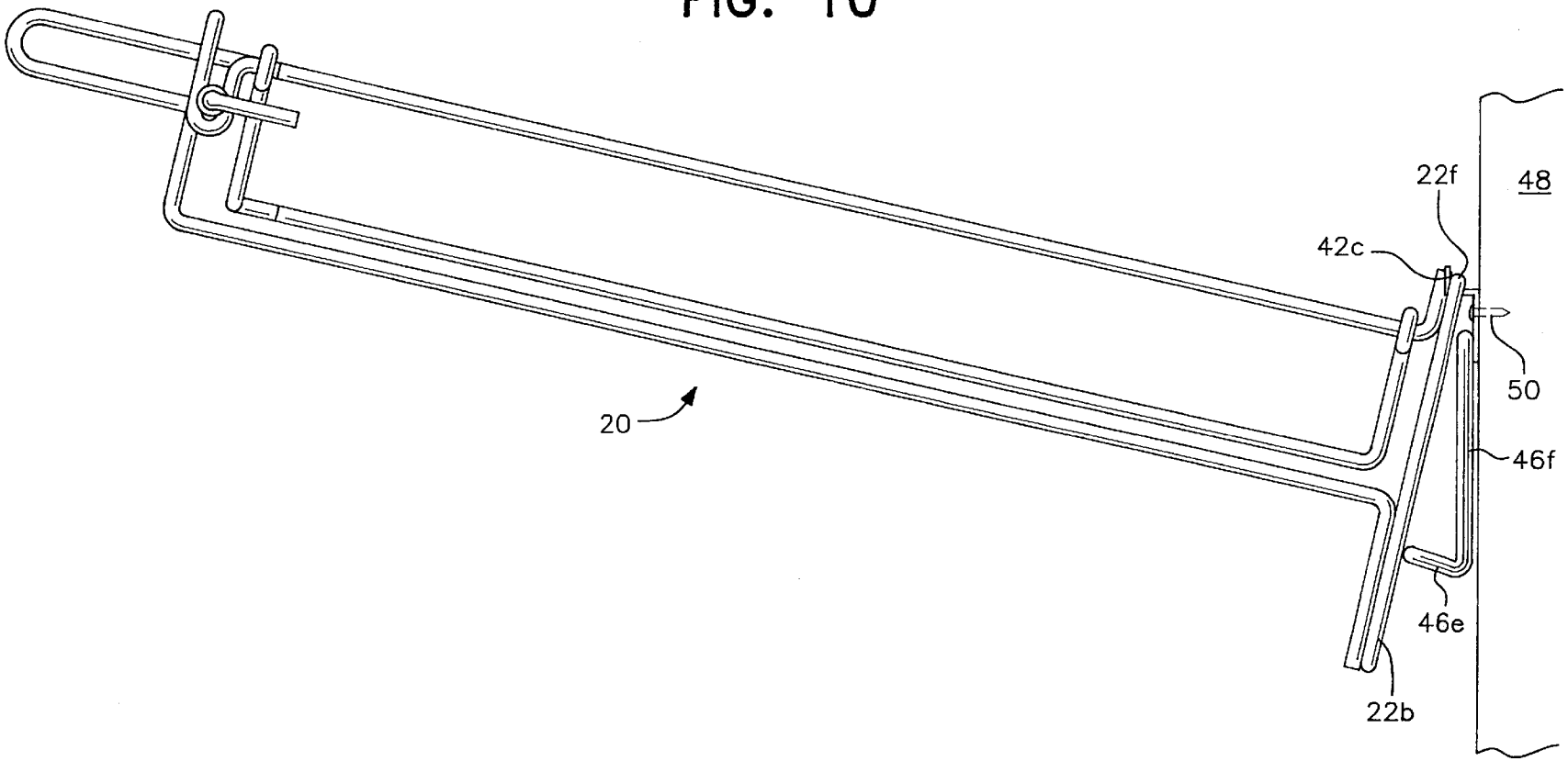
FIG. 10 illustrates the securing of the mounting bracket to a wall and the supporting of the garment hanger caddy of the present invention at an angle with respect to the wall.

For mounting of the hanger caddy at an angle of 15 to 18 degrees, a bracket 40 as shown in FIGS. 8 and 9 is used. Mounting plate 42 includes flat section 42*a* extending to a perpendicularly extending section 42*b* which turns at a right angle to a third section 42*c* located parallel to and spaced ahead of section 42*a*. Section 42*a* includes two screw or bolt holes 44*a* and 44*b*. U-shaped cut-out section 44*c* is located extending from an uppermost edge of plate 42, extending towards a lower most edge.

Welded to the plate 42 is a bent wire 46 having section 46*a* secured at one end to the plate and terminating in an opposite end with perpendicularly extending section 46*b*. Projecting forwardly of section 46*b* is a projecting section 46*c* terminating in support bar section 46*d*. At the opposite end of support section 46*d* is inwardly directed section 46*e*, terminating in vertically extending section 46*f*, which in turn extends to perpendicularly extending section 46*g* secured to plate 42.

For mounting a garment hanger caddy 20 of the present invention, the mounting bracket 40 may be secured to a wall 48 by passing a nail, bolt or screw 50 through the openings 44*a*, 44*b* into the wall. The orientation of the mounting bracket is such that section 24*a* of the glide rod will fit into the recess 44*c* of the mounting bracket and portions of base section 22*f* located on opposite sides of section 24*a* of the glide rod 24 will be supported by section 42*b* of the plate 42. In addition, base sections 22*b* and 22*c* will engage support bar section 46*d* of the bent wire 46. This would position the garment hanger caddy at an angle of approximately 15 to 18 degrees to allow sliding of hangers along the glide rod and also facilitating pivotable movement of the hook guide rod for removal of hangers from the glide rod.

Figure 11:
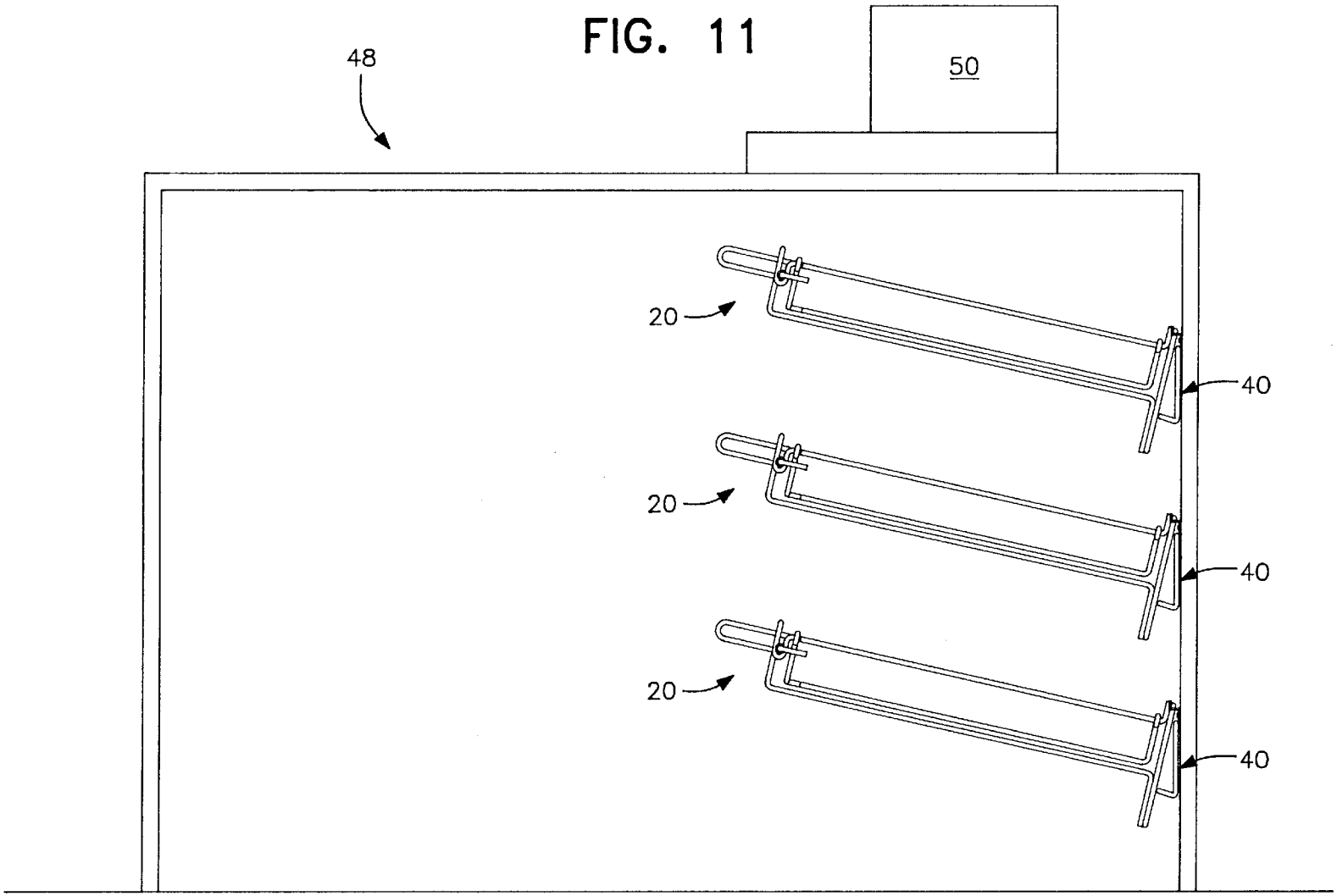
FIG. 11 schematically illustrates the positioning of three hanger caddys at an angle underneath the counter of a cash register.

In FIG. 11, a plurality of garment hanger caddys 20 are shown mounted by mounting brackets 40 under the counter 52 of a cash register 50. Hangers removed from garments at the point of sale are placed on section 24*b* of the glide rod for alignment of the hanger hooks 34*a* and sliding of the hangers 34 along the glide rod 24. The plurality of hangers are thereby neatly stacked beneath a cash register counter.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

I claim:

1. A hanger caddy for holding a plurality of hangers, each of said plurality of hangers having a hook and two arms, said hook including a curved portion and a base portion, said hanger caddy comprising:

a base for supporting the hanger caddy, a glide rod extending from said base for guiding of the curved portion of the hanger hooks in a single orientation as the hangers move toward the base, a hook guide rod extending from said base for guiding of the base portion of the hanger hooks as the hangers move towards the base, a guide rod extending from said base for guiding one of the hanger arms as the hangers move toward the base, and said hook guide rod being pivotally mounted for gaining access to the hangers held on said glide rod by the curved portion of the hook.

2. The hanger caddy as claimed in claim 1, wherein said hook guide rod is secured in an operating position for guiding the hanger hooks of the plurality of hangers and said hook guide rod being movable for gaining access to the plurality of hangers.

3. The hanger caddy as claimed in claim 2, wherein one end of said hook guide rod is pivotally mounted on said glide rod.

4. The hanger caddy as claimed in claim 3, wherein the other end of said hook guide rod is mounted on an extension of the guide rod.

5. The hanger caddy as claimed in claim 4, wherein said extension of said guide rod is curved and with said glide rod defines an opening for receipt in the single orientation of the curved portion of the hook of the plurality of hangers.

6. The hanger caddy as claimed in claim 2, wherein a pivotal clamp secures the hook guide rod in position and releases said hook guide rod to allow pivotal movement of said hook guide rod.

7. The hanger caddy as claimed in claim 1, further comprising a mounting bracket engaging said base.

8. The hanger caddy as claimed in claim 7, wherein said mounting bracket supports said glide rod at an elevation of between 15–18° when said mounting bracket is secured to a wall.

9. The hanger caddy as claimed in claimed 8, wherein said mounting bracket includes a plate, a bent wire frame is secured to said plate.

10. The hanger caddy as claimed in claim 1, wherein said glide rod extends above said guide rod and said hook guide rod.

11. A system for sorting a plurality of hangers, each of said plurality of hangers having a hook and two arms, said hook including a curved portion and a base portion, said system comprising:

a hanger caddy having a glide rod for guiding the curved portion of the hanger hooks in a single orientation and a hook guide rod spaced apart from said glide rod for guiding a base portion of the hanger hooks, a mounting bracket supporting the hanger caddy at an inclined angle from a surface to which it will be mounted for enabling movement of the plurality of hangers along said glide rod, and said hook guide rod being pivotally mounted with respect to said glide rod, said hook guide rod being pivotable between first and second positions for gaining access to the plurality of hangers on said glide rod.

12. The system for sorting a plurality of hangers as claimed in claim 11, wherein one end of said hook guide rod is pivotally mounted on said glide rod.

13. The system for sorting a plurality of hangers as claimed in claim 12, further comprises a hanger arm guide rod secures at a terminate end of the hook guide rod.

14. The system for sorting a plurality of hangers as claimed in claim 11, wherein said mounting bracket supports said glide rod at an elevation of between 15–18° when said mounting bracket is secured to a wall.

15. The system for sorting a plurality of hangers as claimed in claim 14, wherein said mounting bracket includes a plate and a bent wire secured to said plate.

16. The system for sorting a plurality of hangers as claimed in claim 11, wherein a pivotal clamp secures said hook guide rod in position and allows pivotal movement of said hook guide rod.

* * * * *